US010278249B2

(12) United States Patent
Fetterly et al.

(10) Patent No.: US 10,278,249 B2
(45) Date of Patent: Apr. 30, 2019

(54) HIGH AMBIENT TEMPERATURE LED LUMINAIRE WITH THERMAL COMPENSATION CIRCUITRY

(71) Applicant: Dialight Corporation, Farmingdale, NJ (US)

(72) Inventors: Richard H. Fetterly, Jackson, NJ (US); Kevin A. Hebborn, Toms River, NJ (US); Anthony Verdes, Brick, NJ (US); Kenneth Jenkins, Port Monmouth, NJ (US); Virginia Merriam, Milltown, NJ (US)

(73) Assignee: DIALIGHT CORPORATION, Farmingdale, NJ (US)

( * ) Notice: Subject to any disclaimer, the term of this patent is extended or adjusted under 35 U.S.C. 154(b) by 0 days.

(21) Appl. No.: 15/970,458

(22) Filed: May 3, 2018

(65) Prior Publication Data

US 2018/0255618 A1 Sep. 6, 2018

Related U.S. Application Data

(62) Division of application No. 13/939,385, filed on Jul. 11, 2013, now abandoned.

(Continued)

(51) Int. Cl.
*H05B 33/00* (2006.01)
*H05B 33/08* (2006.01)

(Continued)

(52) U.S. Cl.
CPC ..... *H05B 33/0854* (2013.01); *F21V 29/77* (2015.01); *F21V 23/003* (2013.01); *F21Y 2115/10* (2016.08)

(58) Field of Classification Search
CPC ..... H05B 37/0272; H05B 37/0227; H05B 33/0854; H05B 33/0872; H05B 37/0218; H05B 37/0281; H05B 33/0803; H05B 37/029; H05B 37/0236; H05B 33/0857; H05B 33/08; H05B 33/0809; H05B 33/0815; H05B 33/0842; H05B 33/0845; H05B 37/02; H05B 37/0245; H05B 37/03; H05B 33/089; H05B 37/0209; H05B 33/0818; H05B 33/0851; H05B 33/086;

(Continued)

(56) References Cited

U.S. PATENT DOCUMENTS 6,111,739 A 8/2000 Wu et al.
2006/0028155 A1 2/2006 Young (Continued)

FOREIGN PATENT DOCUMENTS

EP 2 355 621 A2 8/2011
EP 2 402 904 1/2012

OTHER PUBLICATIONS

"CTS-OW-PT1000 Installationsanvisning", Nov. 8, 2011. http://calectro.Se/images/product_files/ctsowpt1000_svende_in.pdf.

(Continued)

*Primary Examiner* — Monica C King

(57) ABSTRACT

The present disclosure provides a method for powering a light fixture to provide a constant light output. In one embodiment, the method includes providing a current to one or more light emitting diodes (LEDs), monitoring an external ambient temperature and increasing the current to the one or more LEDs as the external ambient temperature rises to maintain the constant light output.

5 Claims, 4 Drawing Sheets

Related U.S. Application Data

(60) Provisional application No. 61/672,977, filed on Jul. 18, 2012.

(51) Int. Cl.
*F21V 29/77* (2015.01)
*F21V 23/00* (2015.01)
*F21Y 115/10* (2016.01)

(58) Field of Classification Search
CPC ..... H05B 33/0863; H05B 33/0866; H05B 33/0869; H05B 37/0254
See application file for complete search history.

(56) References Cited

U.S. PATENT DOCUMENTS

| | | | |
|---|---|---|---|
| 2006/0226956 | A1 | 10/2006 | Young et al. |
| 2008/0309255 | A1 | 12/2008 | Myers et al. |
| 2011/0134645 | A1 | 6/2011 | Hitchcock et al. |
| 2011/0241549 | A1 | 10/2011 | Wootton |
| 2012/0146548 | A1 | 6/2012 | Campbell et al. |
| 2012/0153830 | A1 | 6/2012 | Guerrieri |

OTHER PUBLICATIONS

European Search Report and Written Opinion, PCT/US2013050861. dated, May 8, 2016, pp. 1-11.
GCC Examination Report dated Aug. 8, 2017 for corresponding GC Application No. 2013-24972, pp. 1-5.
Examination report No. 1 for AU Application No. 2013292641, dated Apr. 11, 2017, pp. 1-3.
International Search Report and Written Opinion for International Patent Application Serial No. PCT/US2013/050861, dated Jan. 22, 2014, consists of 11 unnumbered pages.

HIGH AMBIENT TEMPERATURE LED LUMINAIRE WITH THERMAL COMPENSATION CIRCUITRY

CROSS REFERENCE TO RELATED APPLICATIONS

This application is a divisional of U.S. patent application Ser. No. 13/939,385, filed on Jul. 11, 2013, which claims priority under 35 U.S.C. § 119(e) to U.S. provisional patent application Ser. No. 61/672,977, filed on Jul. 18, 2012, which are hereby incorporated by reference in their entirety.

BACKGROUND

Reliability of electronic parts decreases with increased temperature. Light emitting diode (LED) lights often incorporate schemes whereby LED current is reduced at high operating temperatures in order to reduce internal temperatures at higher ambient temperatures and, thereby, improving reliability. But such schemes result in reduced light output at high operating temperatures. In addition, LED light output reduces as die temperature increases, which results in further reducing light output.

In addition, at ambient temperatures that are low, the brightness of an LED increases. Thus a cold LED light can produce excessive light output. The forward voltage of an LED rises at low temperatures, which causes the power consumption to increase significantly under cold conditions.

SUMMARY

The present disclosure relates generally to a method for powering a light fixture to provide a constant light output. In one embodiment, the method comprises providing a current to one or more light emitting diodes (LEDs), monitoring an external ambient temperature and increasing the current to the one or more LEDs as the external ambient temperature rises to maintain the constant light output.

The present disclosure also provides an LED luminaire. In one embodiment, LED luminaire comprises one or more LEDs, a housing enclosing the one or more LEDs, a temperature sensor located on an exterior side of the housing and coupled indirectly to the exterior side of the housing and an LED driver with a current control coupled to each one of the one or more LEDs and in communication with the temperature sensor, wherein the current control increases a current delivered to the each one of the one or more LEDs as an external ambient temperature increases to maintain a constant light output.

The present disclosure also provides a circuit for maintaining a constant light output of an LED. In one embodiment, the circuit comprises an LED driver with a current control coupled to the LED, wherein the current control increases a current delivered to the LED as an external ambient temperature increases to maintain the constant light output and a temperature sensing device coupled to the LED driver and the LED.

BRIEF DESCRIPTION OF THE DRAWINGS

So that the manner in which the above recited features of the present invention can be understood in detail, a more particular description of the invention may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

To facilitate understanding, identical reference numerals have been used, where possible, to designate identical elements that are common to the figures.

DETAILED DESCRIPTION

The present invention overcomes the conflicting trade-off between low light output and reliability at high temperatures, as well as excessive light output and high power consumption at low temperatures. As discussed above, reliability of electronic parts decreases with increased temperature. Light emitting diode (LED) lights often incorporate schemes whereby LED current is reduced at high operating temperatures in order to reduce internal temperatures at higher ambient temperatures and, thereby, improving reliability. But such schemes result in reduced light output at high operating temperatures. In addition, LED light output reduces as die temperature increases, which results in further reducing light output.

In addition, at ambient temperatures that are low, the brightness of an LED increases. Thus, a cold LED light can produce excessive light output. The forward voltage of an LED rises at low temperatures, which causes the power consumption to increase significantly under cold conditions.

In one embodiment, the present disclosure provides a solution that is counter intuitive to the traditional operation of LED lights in a high ambient temperature. For example, a constant light output is maintained by raising the LED current level as the external ambient temperature rises, rather than reducing it as is normal industry practice. Reliability is maintained by a ruggedized design, which only rolls off LED current at extreme temperatures way beyond those ever likely to be encountered. At the same time, by reducing power consumption at lower temperatures, a long term reliability gain is achieved and less energy is consumed.

It is important to monitor and respond to ambient temperature rather than LED or power supply temperature to avoid positive feedback, which would otherwise result in the light quickly heating itself to a high temperature irrespective of ambient temperature.

Figure 1:
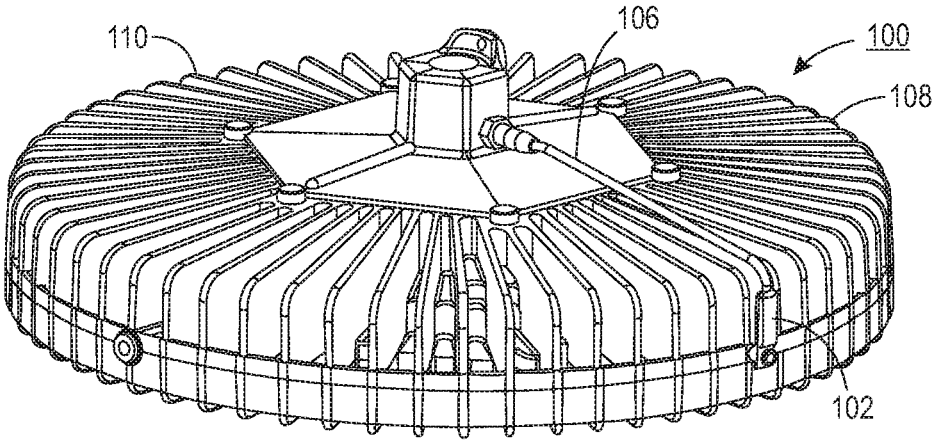
FIG. 1 depicts a complete fixture.

FIG. 1 illustrates one embodiment of an LED light fixture 100. In one embodiment, the LED light fixture 100 may include one or more LEDs that are located inside of a housing 110. In one embodiment, the housing 110 may include one or more heat sink fins 108 coupled to an exterior side of the housing 110. In one embodiment, the placement of the heat sink fins 108 and the design and shape of the heat sink fins 108 may be such that the heat is dissipated away from the housing 110 in a vertical direction in a shape of a plume. In other words, the design of the heat sink fins 108 should be such that heat is concentrated away from the housing 110 and dissipate minimal heat towards a temperature sensor 102. This is to prevent the heat dissipating from the LED light fixture 100 from interfering with external ambient temperature measurements as will be discussed below.

In one embodiment, the LED light fixture 100 may be configured with the temperature sensor 102. The temperature sensor 102 is coupled to an adapter 106 comprising wire and shrink tubing. The temperature sensor 102 may be in communication with a driver or controller (illustrated in FIG. 5 and discussed below) within the LED light fixture 100.

Figure 2:
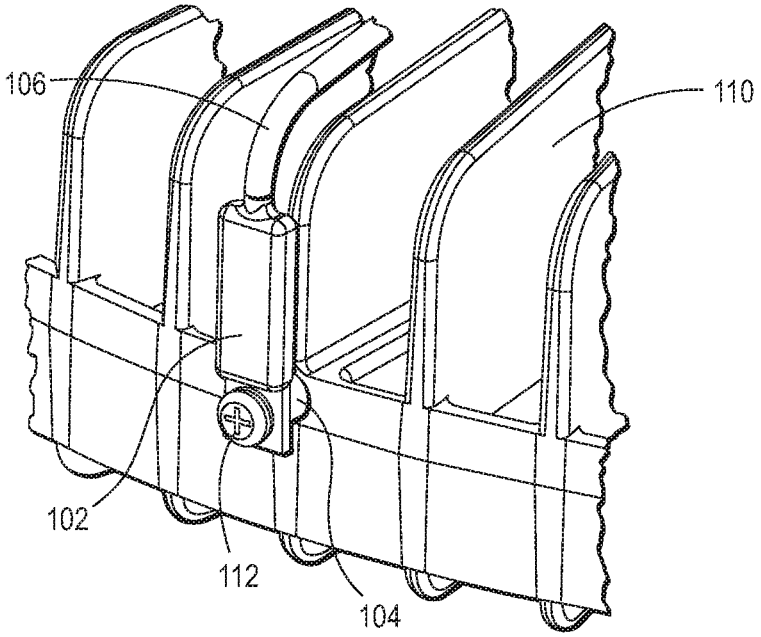
FIG. 2 depicts a close-up of an ambient temperature sensor assembled.

FIG. 2 illustrates a close up of the temperature sensor 102 that is fully assembled. In one embodiment, the temperature sensor 102 may be coupled to the housing 110 by a spacer 104 and a fastener 112. In one embodiment, the fastener may be a screw, bolt, and the like.

Figure 3:
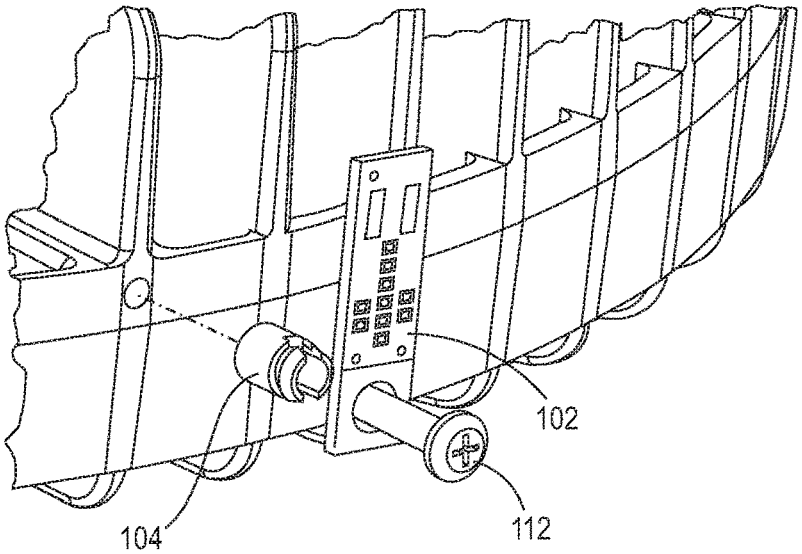
FIG. 3 depicts an exploded view of the ambient temperature sensor.

FIG. 3 illustrates an exploded view of the temperature sensor 102. In one embodiment, the spacer 104 may be long enough to ensure that the temperature sensor 102 is placed sufficiently away from the LED light fixture 100 and the housing 110 such that the temperature sensor reads the ambient air temperature surrounding the LED light fixture 100 and not the temperature of the LED light fixture 100 itself. In other words, the temperature sensor 102 may be coupled indirectly to the housing 110 and away from the housing 110. In other words, the temperature sensor 102 may be considered to be indirectly coupled to the housing 110 because the temperature sensor 102 does not contact the housing 110. In one embodiment, the spacer 104 may be made from any non-conductive material, for example, a polymer or plastic. In one embodiment the spacer 104 may have a length ranging from approximately a few centimeters to a few inches.

In one embodiment, the temperature sensor 102 is also strategically located on a side of the LED light fixture 100. Typically, heat emitted from the LED light fixture 100 will rise vertically upwards directly above the LED light fixture 100. As discussed above, the heat sink fins 108 and the housing 110 are usually designed to dissipate heat vertically upwards. As a result, placing the temperature sensor 102 on a perimeter or side of the LED light fixture 100 also helps to ensure the temperature sensor 102 properly reads the external ambient air temperature and not the temperature of the LED light fixture 100.

Figure 4:
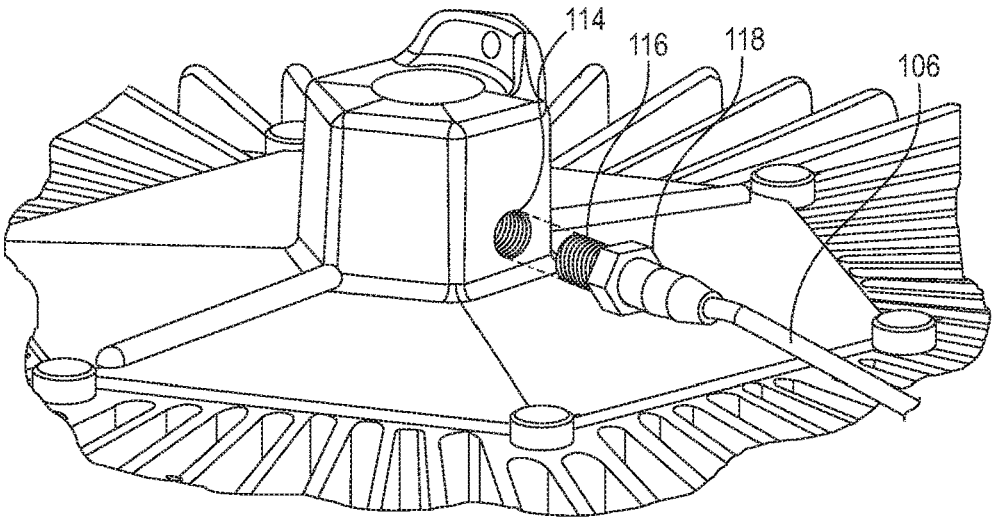
FIG. 4 depicts an exploded view of an adapter.

FIG. 4 illustrates an exploded view of the adapter 106. The adapter 106 includes a wire and shrink tubing that allow the temperature sensor 102 to be communicatively coupled to a driver or controller (illustrated in FIG. 5 and discussed below). In one embodiment, the adapter 106 may have a threaded portion 116 and a locking nut 118 that is used to couple the adapter 106 to an opening 114 in the housing 110. The adapter 106 may be communicatively coupled to the driver or controller inside the housing 110 of the LED light fixture 100.

As noted above, in one embodiment, to achieve the ability to increase current at higher temperatures to maintain a constant light output, a high powered LED may be implemented in the light fixture but initially powered at a lower current. For example, if an application requires 100 lumens of light output, an LED having the ability to output 200 lumens of light may be used but driven to initially output 100 lumens at an initial temperature.

Using the above example, unlike previous applications that would drive an LED at the full 200 lumens, by driving the LED at only 100 lumens, provides the ability to increase current as the ambient temperature rises to maintain a constant light output. In previous techniques, by driving the LED at the full 200 lumens, as the ambient temperature rises, the current must be reduced to reduce the heat output of the LED to avoid failure. As a result, the light output would be reduced as the ambient temperature rises.

In addition, as noted above, using a high powered LED and initially powering it at a lower current provides additional advantages. For example, lower power is consumed, the LED may have a longer life, reliability of the LED is increased, and the like.

Figure 5:
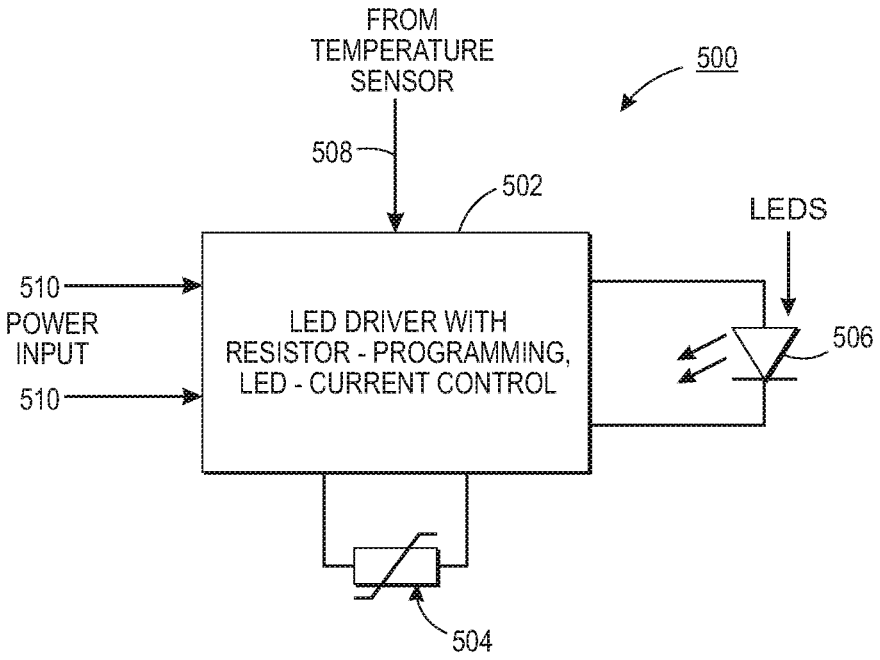
FIG. 5 depicts a high level block circuit diagram of a thermal compensation circuit.

FIG. 5 illustrates one embodiment of a high level block circuit diagram of a thermal compensation circuit 500 located inside of the LED light fixture 100. It should be noted that FIG. 5 has been simplified to illustrate one or more components of the thermal compensation circuit 500 to adjust current based upon the external ambient temperature. In other words, the circuit 500 may include other components (e.g., diodes, switches, transistors, resistors, inductors, capacitors, and the like) for operation of the overall lighting fixture.

In one embodiment, the circuit 500 includes an LED driver 502 having a current control, one or more LEDs 506 coupled to the LED driver 502 and one or more temperature sensing devices 504 coupled to the LED driver 502 and the LEDs 506. The temperature sensing device 504 may be, for example, a positive temperature coefficient (PTC) thermistor, a negative temperature coefficient (NTC) thermistor, and the like.

In one embodiment, the external ambient temperature reading is fed to the LED driver 502 as in an input 508. In addition, power inputs 510 are provided to the LED driver 502.

In one embodiment, the LED driver 502 may include a processor and a computer readable storage medium for storing information to control the current delivered to the LEDs 506. For example, data relating to a relationship between the current and external ambient temperature may be stored in the computer readable storage medium such that the LED driver may know how to adjust the current based upon the external ambient temperature received at input 508. In one embodiment, the relationship between the current and the external ambient temperature may be linear, exponential, a step function, and the like.

In one embodiment, the LED driver 502 may have a resistor programming feature that allows the current delivered to the LED 506 to be set by means of the temperature sensing device 504, e.g., a PTC thermistor. Higher resistor values give higher LED current. In one embodiment, the current may be set in accordance with a function or a predefined relationship of makeup current required to maintain a constant LED light output versus various external ambient temperatures. For example, the relationship may be linear in one embodiment. In another embodiment, the relationship may be logarithmic or may be a step function. Thus, at a given ambient temperature, the LED driver may know exactly how much current to provide to maintain a constant light output for the LED 506.

In other words, as the external ambient temperature rises, the light output of the LED 506 will decrease. Thus, the function will define how much the light output will decrease based upon the higher external ambient temperature. The additional current that is required may then be calculated based upon the predicted light output in accordance with the function or relationship between the light output versus the external ambient temperatures.

In operation that uses a PTC thermistor as the temperature sensing device 504, as ambient temperature rises the resistance of the PTC thermistor increases, thereby, causing the LED driver 502 to deliver more current to the LED 506. In one embodiment, the PTC thermistor may be several in series and may be combined with one or more additional PTC thermistors or other types of resistors to create the desired LED current/LED light output versus temperature characteristic.

In one embodiment, the circuit 500 may be used to allow the light fixture 100 to automatically adjust the current to the LEDs based upon the external ambient temperature that is measured. It should also be noted that FIG. 5 illustrates one embodiment of a way to implement the present invention. Other configurations are possible and the example provided herein should not be considered limiting. Other configurations may include use of different temperature sensor types, inclusion of a microcontroller between the sensor and LED driver to control the LED current, and the like.

Figure 6:
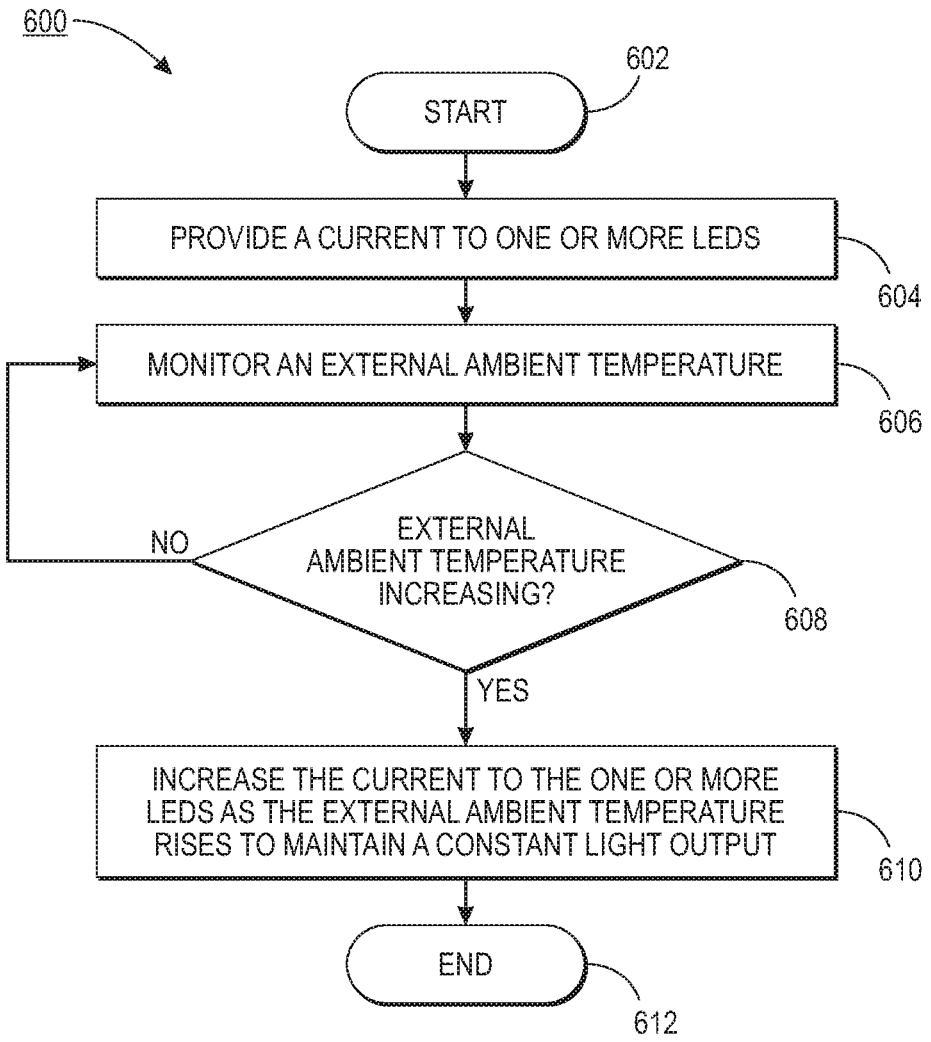
FIG. 6 depicts an example flow diagram of one embodiment of a method for powering a light fixture to provide a constant light output.

FIG. 6 illustrates a flowchart of a method 600 for powering a light fixture to provide a constant light output. In one embodiment, one or more steps or operations of the method 600 may be performed by the LED light fixture 100 or the circuit 500.

The method 600 begins at step 602. At step 604, the method 600 provides a current to one or more LEDs. In one embodiment, the LEDs have a higher maximum light output than the light output required for a particular application. For example, if the application requires 100 lumens of light, the LEDs that are used may be LEDs with a maximum light output of 200 lumens.

As a result, the initial current that is provided to the LEDs may be reduced or lower than the maximum required current (e.g., half of the maximum current) to power the LEDs to produce 100 lumens of light. As a result, the LEDs would consume less power, the LEDs would have a longer life and the reliability of the LEDs would be increased.

At step 606, the method 600 monitors an external ambient temperature. For example, a temperature sensor on an external side of a housing of the light fixture may continuously measure the external ambient temperature. In one embodiment, the temperature sensor may be located on a side or a perimeter of the housing. This may be to avoid the heat that rises like a plume vertically above the light fixture from affecting the external ambient temperature measurement. In addition, the temperature sensor may be located away from the external side of the housing via a non-conductive spacer to avoid the housing from affecting the external ambient temperature measurement.

At step 608, the method 600 determines if the external ambient temperature is increasing. If the external ambient temperature is not increasing, the method 600 returns to step 606 to continue monitoring the external ambient temperature. However, if the external ambient temperature is increasing at step 608, the method 600 proceeds to step 610.

At step 610, the method 600 increases the current to the one or more LEDs as the external ambient temperature rises to maintain a constant light output. For example, an LED driver with a current control inside of the light fixture may adjust the current delivered to the LEDs based upon the external ambient temperature. Counter intuitively, the method 600 may increase the current as the external ambient temperature rises to maintain a constant light output, rather than decrease the current as traditionally done in previous methods.

In one embodiment, the current may be controlled by a resistor, for example a PTC thermistor, that is coupled to the LEDs and the LED driver. As the external ambient temperature rises, the resistance of the PTC thermistor increases. As a result, the LED driver delivers more current to the LEDs as the resistance of the PTC thermistor increases.

In one embodiment, the makeup amount of current required to maintain a constant light output of the LED as the external ambient temperature rises may be a function of a relationship between a makeup current required to maintain the constant light output versus the external ambient temperature. In one embodiment, the relationship may be linear. At step 612, the method 600 ends.

In one embodiment, the method 600 may continue to monitor the external ambient temperature to continually adjust the current delivered to the LEDs based upon any changes to the external ambient temperature (e.g., additional increases or decreases in the external ambient temperature). Thus, in one embodiment, the method 600 may not end but continually loop between steps 606, 608 and 610 and adjust the current (e.g., increase or decrease the current) in accordance with any increase or decrease in the external ambient temperature.

It should be noted that although not explicitly specified, one or more steps, functions, or operations of the method 600 described above may include a storing, displaying and/or outputting step as required for a particular application. In other words, any data, records, fields, and/or intermediate results discussed in the methods can be stored, displayed, and/or outputted to another device as required for a particular application. Furthermore, steps, functions, or operations in FIG. 6 that recite a determining operation, or involve a decision, do not necessarily require that both branches of the determining operation be practiced. In other words, one of the branches of the determining operation can be deemed as an optional step.

While various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

What is claimed is:

1. A light emitting diode (LED) luminaire, comprising:

one or more LEDs having a maximum light output that is higher than a required light output for a particular application;

a housing enclosing the one or more LEDs;

a plurality of heat sink fins coupled to the housing to dissipate heat away from the housing in a vertical direction in a shape of a plume;

a temperature sensor located on an exterior side of the housing along a perimeter of the housing via a spacer;

an LED driver with a current control coupled to each one of the one or more LEDs and in communication with the temperature sensor, wherein the current control:

provides a current to the one or more LEDs that is less than a maximum current such that the current powers the one or more LEDs at a light output less than the maximum light output;

calculates an amount of makeup current based upon a linear relationship between the current and an external ambient temperature that is stored in a computer readable storage medium; and increases the current to the one or more LEDs by the amount of makeup current that is calculated as the external ambient temperature rises to maintain a constant light output; and an adapter to communicatively couple the temperature sensor to the LED driver, wherein the adapter comprises a threaded portion and a locking nut to couple an end of the adapter to an opening in the housing.

2. The LED luminaire of claim 1, wherein the each one of the one or more LEDs is driven at a current less than a maximum current to power the each one of the one or more LEDs at a light output less than the maximum light output.

3. The LED luminaire of claim 1, wherein the spacer comprises a non-conductive material.

4. The LED luminaire of claim 1, further comprising:

a positive temperature coefficient thermistor coupled to the LED driver and the each one of the one or more LEDs.

5. A circuit for maintaining a constant light output of a light emitting diode (LED) having a maximum light output that is higher than a required light output for a particular application, the circuit comprising:

an LED driver with a current control coupled to the LED, wherein the current control provides a current to the LED that is less than a maximum current such that the current powers the LED at a light output less than the maximum light output, calculates an amount of makeup current based upon a linear relationship between the current and an external ambient temperature that is stored in a computer readable storage medium, and increases the current to the LED by the amount of makeup current that is calculated as the external ambient temperature rises to maintain a constant light output; and a temperature sensing device coupled to the LED driver and the LED, wherein the temperature sensing device is located on an exterior side of a housing of the LED and along a perimeter of the housing via a spacer, wherein the housing comprises a plurality of heat skink fins that are shaped to dissipate heat away from the housing in a vertical direction in a shape of a plume.

* * * * *